US011285079B2

(12) United States Patent
Chou et al.

(10) Patent No.: US 11,285,079 B2
(45) Date of Patent: Mar. 29, 2022

(54) FREEZE-FREE MEDICINAL TRANSPORT CARRIERS

(71) Applicant: Tokitae LLC, Bellevue, WA (US)

(72) Inventors: Fong-Li Chou, Bellevue, WA (US); Brian L. Pal, Medina, WA (US); Matthew W. Peters, Sammamish, WA (US); Nels R. Peterson, Bellevue, WA (US); David J. Yager, Carnation, WA (US)

(73) Assignee: Tokitae, LLC, Bellevue, WA (US)

( * ) Notice: Subject to any disclaimer, the term of this patent is extended or adjusted under 35 U.S.C. 154(b) by 453 days.

(21) Appl. No.: 16/000,075

(22) Filed: Jun. 5, 2018

(65) Prior Publication Data

US 2018/0353379 A1 Dec. 13, 2018

Related U.S. Application Data

(60) Provisional application No. 62/518,374, filed on Jun. 12, 2017.

(51) Int. Cl.
*A61J 1/16* (2006.01)
*F25D 3/08* (2006.01)

(52) U.S. Cl.
CPC ..... *A61J 1/165* (2013.01); *F25D 3/08* (2013.01); *A61J 2200/50* (2013.01); *A61J 2200/72* (2013.01); *A61J 2205/20* (2013.01); *F25D 2303/085* (2013.01); *F25D 2303/0843* (2013.01)

(58) Field of Classification Search
CPC .... A61J 1/165; A61J 2200/50; A61J 2200/72; A61J 2205/20; F25D 3/08; F25D 2303/0843; F25D 2303/085
See application file for complete search history.

(56) References Cited

U.S. PATENT DOCUMENTS 5,181,394 A 1/1993 Schea, III et al.
6,609,392 B1 8/2003 Brown
(Continued)

FOREIGN PATENT DOCUMENTS

CN 103625781 A 3/2014
CN 104709603 A 6/2015

OTHER PUBLICATIONS

PCT International Search Report; International App. No. PCT/US2018/036396; dated Sep. 18, 2018; pp. 1-3.
(Continued)

*Primary Examiner* — Joseph F Trpisovsky
(74) *Attorney, Agent, or Firm* — Adam L. K. Philipp; Shan Liao; AEON Law

(57) ABSTRACT

In some embodiments, a medicinal carrier device includes: one or more sections of thermal insulation positioned to form an internal space with an adjacent first side region and an adjacent second side region; a first panel including a first phase change material positioned within the first side region of the internal space, the first side region of a size and shape to firmly contain an integral number of portable cold packs in thermal contact with the first panel; and a second panel including a second phase change material positioned within the second side region of the internal space, the second side region of a size and shape to firmly contain an integral number of portable cold packs in thermal contact with the second panel.

9 Claims, 15 Drawing Sheets

(56) References Cited

U.S. PATENT DOCUMENTS

| | | | | |
|---|---|---|---|---|
| 8,695,373 | B1 * | 4/2014 | Patton | F25D 3/08 62/457.6 |
| 2007/0028642 | A1 | 2/2007 | Glade et al. | |
| 2008/0135564 | A1 | 6/2008 | Romero | |
| 2008/0276643 | A1 | 11/2008 | Heroux et al. | |
| 2012/0305435 | A1 * | 12/2012 | Matta | B65D 81/3862 206/521 |
| 2015/0068242 | A1 * | 3/2015 | Patstone | B23P 15/26 62/457.2 |
| 2015/0191291 | A1 * | 7/2015 | Wood | B65D 81/3834 220/592.1 |
| 2016/0362240 | A1 * | 12/2016 | Ferracamo, Jr. | A61J 1/165 |
| 2017/0023290 | A1 * | 1/2017 | Demuth | F25D 25/022 |
| 2017/0115046 | A1 | 4/2017 | Blezard et al. | |
| 2018/0036202 | A1 * | 2/2018 | Wengreen | B65D 81/18 |

OTHER PUBLICATIONS

"Freeze-Preventive Vaccine Carriers"; Technology Solutions for Global Health; Feb. 2018; one page; www.path.org.

"Freeze-prevention design for vaccine carriers, cold boxes and other passive cold chain equipment to prevent freezing of vaccines, drugs or pharmaceuticals in the cold chain"; The Industry Standard Disclosure Publication Service; published in the Feb. 2016 paper journal; Research Disclosure database No. 622008; published digitally Jan. 5, 2016; pp. 1-6.

Press Release—"First vaccine carrier approved by World Health Organization to prevent vaccine freezing during transport commercially available"; Feb. 7, 2018; pp. 1-4; http://www.path.org/news/press-room/866/ [May 29, 2018 11:45:14AM] Path.

World Health Organization PQS performance specification titled: Vaccine carrier with freeze-prevention technology; May 30, 2017; pp. 1-15; WHO/PQS/E004/VC02.1.

* cited by examiner

FREEZE-FREE MEDICINAL TRANSPORT CARRIERS

If an Application Data Sheet (ADS) has been filed on the filing date of this application, it is incorporated by reference herein. Any applications claimed on the ADS for priority under 35 U.S.C. §§ 119, 120, 121, or 365(c), and any and all parent, grandparent, great-grandparent, etc. applications of such applications, are also incorporated by reference, including any priority claims made in those applications and any material incorporated by reference, to the extent such subject matter is not inconsistent herewith.

CROSS-REFERENCE TO RELATED APPLICATIONS

The present application claims the benefit of the earliest available effective filing date(s) from the following listed application(s) (the "Priority Applications"), if any, listed below (e.g., claims earliest available priority dates for other than provisional patent applications or claims benefits under 35 USC § 119(e) for provisional patent applications, for any and all parent, grandparent, great-grandparent, etc. applications of the Priority Application(s)).

PRIORITY APPLICATIONS

The present application claims benefit of priority of U.S. Provisional Patent Application No. 62/518,374, entitled FREEZE-FREE MEDICINAL TRANSPORT CARRIERS, naming FONG-LI CHOU, BRIAN L. PAL, MATTHEW W. PETERS, NELS R. PETERSON, AND DAVID J. YAGER as inventors, filed 12 Jun. 2017, which was filed within the twelve months preceding the filing date of the present application or is an application of which a currently co-pending priority application is entitled to the benefit of the filing date.

If the listings of applications provided above are inconsistent with the listings provided via an ADS, it is the intent of the Applicant to claim priority to each application that appears in the Domestic Benefit/National Stage Information section of the ADS and to each application that appears in the Priority Applications section of this application.

All subject matter of the Priority Applications and of any and all applications related to the Priority Applications by priority claims (directly or indirectly), including any priority claims made and subject matter incorporated by reference therein as of the filing date of the instant application, is incorporated herein by reference to the extent such subject matter is not inconsistent herewith.

SUMMARY

In some embodiments, a medicinal carrier device includes: one or more sections of thermal insulation positioned to form an internal space with an adjacent first side region and an adjacent second side region; a first panel including a first phase change material positioned within the first side region of the internal space, the first side region of a size and shape to firmly contain an integral number of portable cold packs in thermal contact with the first panel; and a second panel including a second phase change material positioned within the second side region of the internal space, the second side region of a size and shape to firmly contain an integral number of portable cold packs in thermal contact with the second panel.

In some embodiments, a medicinal carrier device includes: one or more sections of thermal insulation positioned to form an internal space of a size and shape to hold medicinals; and one or more thermally conductive barriers positioned within the internal space between an interior medicinal storage region and one or more external portable cold pack storage regions, the one or more thermally conductive barriers formed from phase change material encapsulated within a thermally-conductive material, wherein the phase change material encapsulated within the one or more thermally conductive barriers has a latent heat of fusion greater than the specific heat capacity of portable cold packs equivalent to the volume of the external portable cold pack storage regions.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
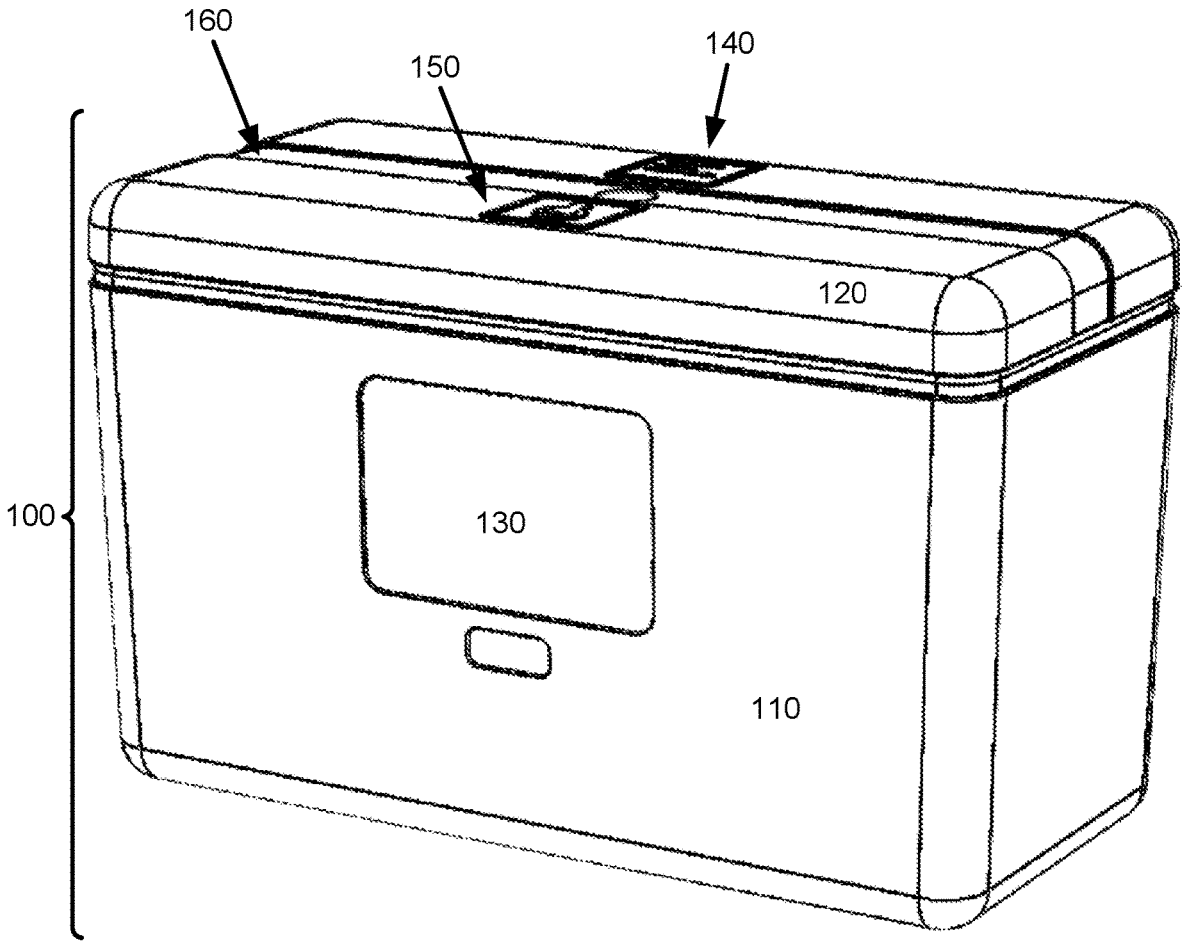
FIG. 1 is a schematic of a medicinal carrier device.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Easily portable medicinal carrier devices are used for transport of small volumes of medicinal materials for several hours while maintaining the interior storage region in a defined temperature range above 0 degrees C. Many medicinals, such as vaccines, antibiotics, blood products and the like, must be maintained within a predetermined temperature range in order to preserve their stability and/or efficacy. For example, medicinal carrier devices including internal medicinal storage regions between 0.5 liter (L) and 2 L volumes are used to transport medicinals such as vaccines, antibiotics, and medical treatment materials within a consistent temperature range above 0 degrees C. for periods between 3 to 8 hours. In some embodiments, the medicinal carrier devices are insulated rectangular structures, in a boxlike shape, with exterior handles or straps and a reversibly removable lid. In some embodiments, the medicinal carrier devices are used to transport medicinals that should be stored within a range between 2 degrees C. and 10 degrees C. In some embodiments, the medicinal carrier devices are used to transport medicinals that should be stored within a range between 2 degrees C. and 8 degrees C. In some embodiments, the medicinal carrier devices are used to transport medicinals that should be stored within a range between 4 degrees C. and 8 degrees C.

Generally, the medicinal storage region within a medicinal carrier device is maintained at a temperature less than ambient temperature and slightly above freezing with the addition of one or more portable cold packs containing water ice to the medicinal storage region. For example, the WHO and UNICEF provide standards (e.g. WHO/UNICEF E5 IP) for portable cold packs including the size, shape and volume of the portable cold packs for use with vaccine storage. Generally, portable cold packs approved by the WHO and UNICEF consist of plastic containers of a predefined volume that are filled with water to form ice when frozen. These portable cold packs are routinely retained in freezers prior to use within medicinal storage devices. However freezers used with portable cold packs are set to temperatures below the freezing point of water, sometimes substantially below (e.g. −20 degrees C.). This results in the portable cold packs being frozen to temperatures below, sometimes significantly below, the storage range of medicinals that should be stored within a range between 2 degrees C. and 10 degrees C. Use of portable cold packs at these very low temperatures can result in damage to the medicinals stored within medicinal storage devices, sometimes freezing the medicinals and correspondingly reducing their clinical effectiveness. Clinical use protocols exist for the conditioning of portable cold packs after removal from a freezer and prior to use with medicinals that should be stored within a range between 2 degrees C. and 10 degrees C. For example, some clinical use protocols require conditioning of portable cold packs prior to use by setting them at room temperature for a fixed period of time. For example, some clinical use protocols require conditioning of portable cold packs prior to use by setting them at room temperature until the material within the portable cold packs is partially thawed (e.g. sloshes when shaken). However, these clinical use protocols require training of personnel and time to carry out, leading to instances where they are not carried out due to lack of training and/or time pressures and the resulting possible use of a medicinal storage device with a storage region above or below the approved storage range for medicinals (e.g. a range between 2 degrees C. and 10 degrees C.).

Medicinal carrier devices as described herein are designed for use with portable cold packs taken directly from a freezer, including a freezer maintained significantly below freezing (e.g. −20 degrees C., or −30 degrees C.) without cooling the interior storage area of the carrier below the storage range of medicinals that should be stored within a range between 2 degrees C. and 10 degrees C. The medicinal carrier devices as described herein are designed to maintain the internal medicinal storage region within a range between 2 degrees C. and 10 degrees C. during use, typically from 8-12 hours, but in some embodiments up to 36 hours, with a single set of portable cold packs taken from a freezer. A set of portable cold packs can be a single cold pack, 2 cold packs, 3 cold packs, 4 cold packs, or another integral number of cold packs depending on the embodiment. The medicinal carrier devices as described herein include phase change materials with solid-liquid transition points within the use range, e.g. a range between 2 degrees C. and 10 degrees C., positioned between the frozen portable cold packs and the medicinal storage region.

In some embodiments, the phase change materials are embedded in a solid structure to provide support and to maintain the position of the portable cold packs while the carrier is being used as transport for medicinals. For example, some embodiments utilize microencapsulated phase change material, or phase change material that is encapsulated within a polymer or plastic to form particle sizes in the 15-30 micron range (e.g. MPCM6, available from Microtek Laboratories Inc.). These microencapsulated phase change materials are further solidified in an epoxy material. For example, some embodiments include a 1:1 mixture by volume of TAP Marine Grade 314 Resin and TAP Marine Grade 143 Hardener (available from TAP Plastics, Inc.). Microencapsulated phase change material can be mixed with the epoxy mixture at a 1.5:1 ratio by weight composition and then formed into appropriate structures prior to hardening. For example, a solid phase change material including microencapsulated phase change material with a phase change temperature of 6 degrees C. mixed with the epoxy mixture at a 1.5:1 ratio by weight can be formed into a structure at least 1 cm thick to be positioned within a medicinal carrier between a portable cold pack and the medicinal storage region. Such a configuration can be utilized, for example, with portable cold packs at −25 degrees C. while maintaining the medicinal storage region of the device in a range between 2 degrees C. and 10 degrees C. The dimensions of the phase change material depend on the embodiment, and are based on factors including the desired temperature range of the medicinal storage region, the phase change material utilized, the portable cold pack size, expected starting temperature and material, and the size and shape of the internal space of the carrier.

Use of microencapsulated phase change materials solidified in an epoxy material can provide for the use of phase change materials with transition temperatures above or below that of water. For example, assuming that a storage region of a medicinal carrier device needs to be maintained in a range between 2 degrees C. and 10 degrees C., an embodiment might include a phase change material with a transition temperature in the middle of the storage range, such as approximately 6 degrees C. Use of such phase change materials with embodiments such as described herein can minimize the possibility of a medicinal storage region interior migrating outside of the optimal temperature range, even when used with portable cold packs cooled substantially below zero degrees (e.g. to −20 degrees C., or to −30 degrees C.). Use of encapsulated phase change material can also reduce the risk of leaks of phase change material even if the device is damaged. Embodiments such as described herein also provide for rapid cooling of the interior of a storage region in a device prior to use, and rapid equilibration in the appropriate temperature range (e.g. minutes to equilibrate).

Some embodiments further include a thermochromatic dye added to the solidified phase change material to indicate its current temperature. For example, a particular block of solid phase change material might not be suitable for immediate use if it has been exposed to excessive ambient temperatures (e.g. left in a hot or sunny location outside of the medicinal carrier). For example, a thermochromatic dye can indicate when a portion of a block of solidified phase change material is in contact with a portable cold pack that is currently at a temperature significantly below zero degrees C. (e.g. −20 degrees C.). In some embodiments, a thermochromatic dye in a powder form with color change properties as desired for an embodiment can be added to the microencapsulated phase change material-epoxy mixture described above at a weight equivalent to 0.5% to 1% of the microencapsulated phase change material.

In some embodiments, a medicinal carrier device includes: one or more sections of thermal insulation positioned to form an internal space with an adjacent first side region and an adjacent second side region; a first panel including a first phase change material positioned within the first side region of the internal space, the first side region of a size and shape to firmly contain an integral number of portable cold packs in thermal contact with the first panel; and a second panel including a second phase change material positioned within the second side region of the internal space, the second side region of a size and shape to firmly contain an integral number of portable cold packs in thermal contact with the second panel.

FIG. 1 depicts an embodiment of a medicinal carrier device 100 formed as a rectangular, box-like structure. In some embodiments, a medicinal carrier device can be formed as a square box, a cylinder, or other shapes as convenient for use in an expected situation. The medicinal carrier device 100 depicted in FIG. 1 includes a storage portion 110 with a lid 120. The exterior surface of the storage portion 110 includes an optional side label area 130. The lid 120 includes an optional top labeling area 140. The lid 120 also includes a latch 150. In the illustrated embodiment, an indentation 160 runs along the length of the lid 120, the indentation of a size, shape and position to reversibly mate with a strap or handle. In the embodiment illustrated in FIG. 1, the exterior of the medicinal carrier device is a solid plastic material. An exterior material can be chosen for factors such as durability, weight, cost, appearance and ease of incorporation into the manufacture process for a medicinal carrier device.

Figure 2:
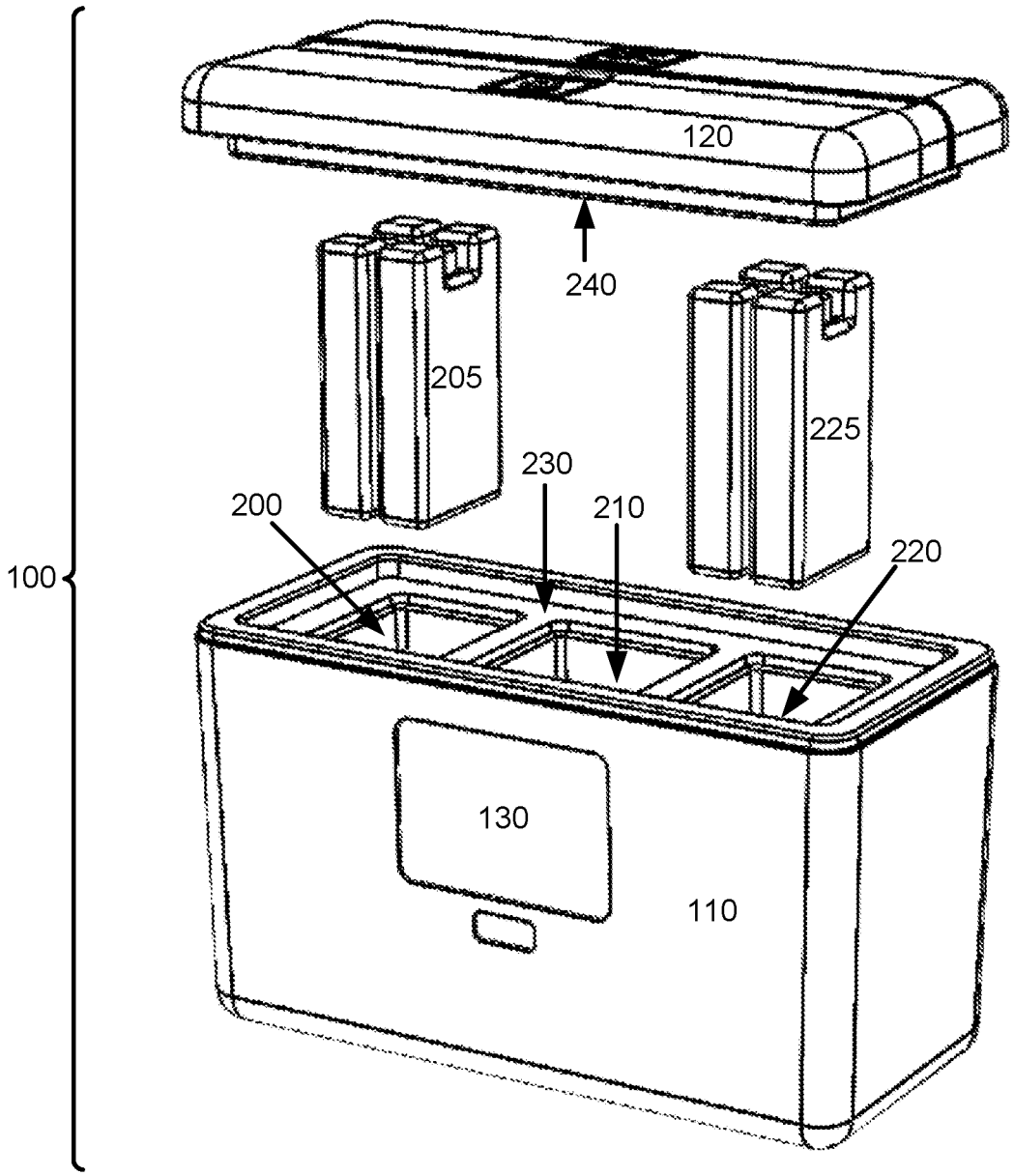
FIG. 2 is a schematic of a medicinal carrier device.

FIG. 2 depicts a medicinal carrier device 100 as it could be used with pairs of portable cold packs 205, 225. The medicinal carrier device 100 includes a storage portion 110 and a lid 120. The interior region of the storage portion 110 is divided with a liner 230 into a central medicinal storage region 210 with a first side region 200 and a second side region 220. The first side region 200 and a second side region 220 are positioned distally to each other in the rectangular interior region of the storage portion 110, with the medicinal storage region 210 positioned between the first side region 200 and the second side region 220. Phase change material is positioned between the medicinal storage region 210 and each of the first side region 200 and the second side region 220, although in the view of FIG. 1 the phase change material is not visible due to the cover of the liner. The first side region 200 is of a size and shape to securely position a pair of portable cold packs 205 against the wall between the first side region 200 and the medicinal storage region 210, wherein the wall contains a panel of phase change material. The second side region 220 is of a size and shape to securely position a pair of portable cold packs 225 against the wall between the second side region 220 and the medicinal storage region 210, wherein the wall contains a panel of phase change material.

Figure 3:
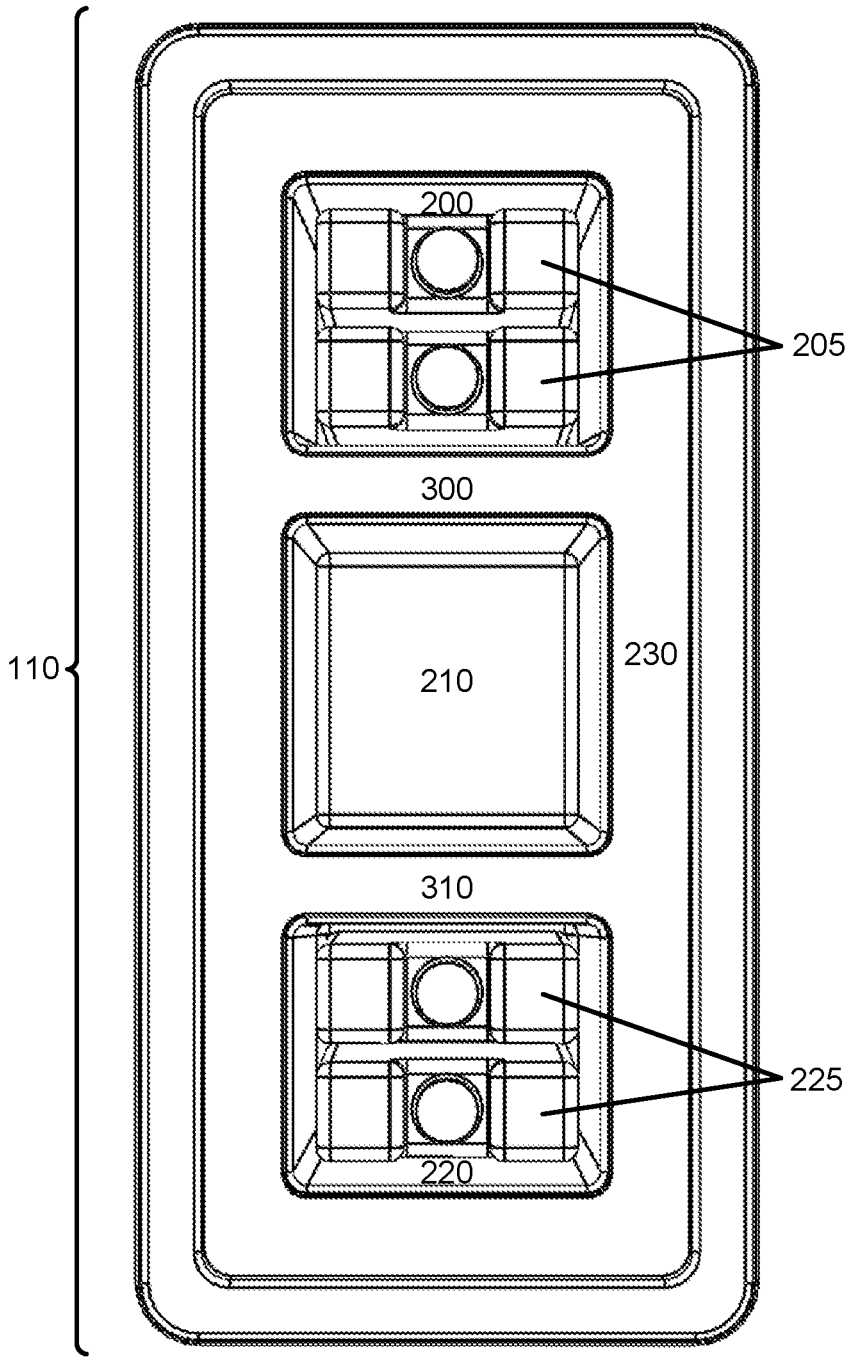
FIG. 3 is a schematic of a medicinal carrier device.

FIG. 3 depicts a top down view of a storage portion 110 similar to the one illustrated in FIGS. 1 and 2. The interior of the storage portion 110 includes a liner 230 which divides the interior space and forms three compartment regions. The liner is fabricated from a thin, thermally-conductive material. In some embodiments the liner is fabricated from a plastic or polymer material. A first side region 200 contains a pair of portable cold packs 205. A first wall 300 is positioned between the first side region 200 and a central medicinal storage region 210. A first panel of phase change material is positioned within the first wall 300, underneath the liner 230 in the view of the figure. A second side region 220 also includes a pair of portable cold packs 225. A second wall 310 is positioned between the second side region 220 and the central medicinal storage region 210. A second panel of phase change material is positioned within the second wall 310, obscured the liner 230 in the view of the figure. The first and second side regions 200, 220 are of a size, shape and configuration to firmly hold the first and second pairs of portable cold packs 205, 225 against the respective walls 300, 310 between the side regions 200, 220 and the storage region 210.

Figure 4:
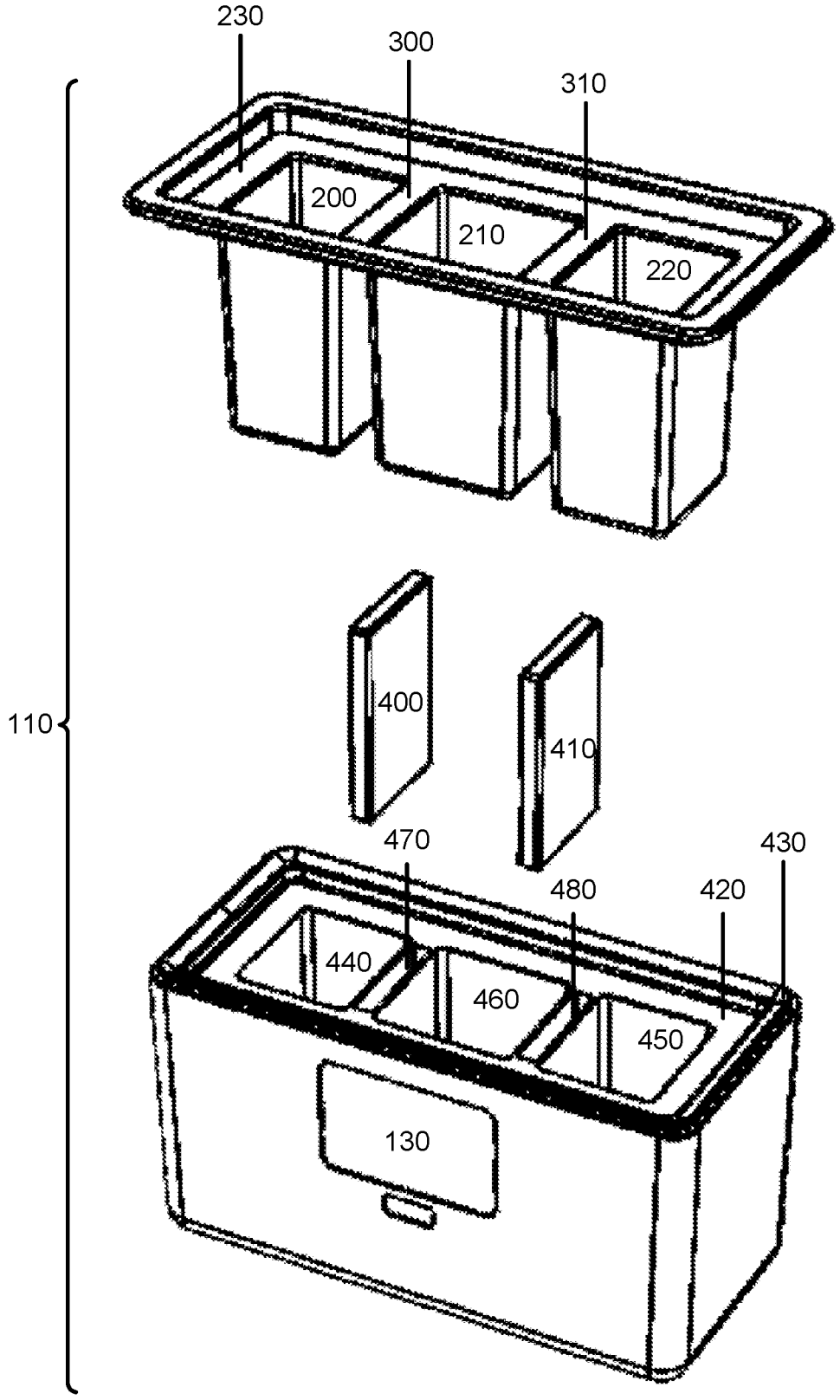
FIG. 4 is a schematic of an adaptation kit and a medicinal carrier device.

FIG. 4 depicts a storage portion 110 similar to the one illustrated in the prior figures. The storage portion 110 includes an outer covering 430 around an internal section of insulation 420. The section of thermal insulation 420 is positioned to form an internal space 460 with an adjacent first side region 440 and an adjacent second side region 450. A first slot 470 is positioned between the internal space 460 and the adjacent first side region 440. The first slot 470 is of a size, shape and position to hold a first panel of phase change material 400 between the internal space 460 and the adjacent first side region 440. The storage portion 110 also includes a second side region 450 adjacent to a distal side of the internal space 460 to the first side region 440. A second slot 480 is positioned between the internal space 460 and the adjacent second side region 450. The second slot 480 is of a size, shape and position to hold a second panel of phase change material 410 between the internal space 460 and the adjacent second side region 450. The storage portion 110 also includes a liner 230, of a size, shape and configuration to mate to the surface of the insulation 420 and the top edge surfaces of the first and second panels of phase change material 400, 410. The liner 230 is formed with a first side region 200, a second side region 220 and a center storage region 210. When the storage portion 110 is assembled, a first wall 300 is formed between the first side region 200 and the center storage region 210. The first panel of phase change material 400 is within the wall 300 under the liner 230 and supported by the insulation 420. A second wall 310 is also formed between the second side region 220 and the center storage region 210. The second panel of phase change material 410 is within the second wall 310 under the liner 230 and supported by the insulation 420.

Figure 5:
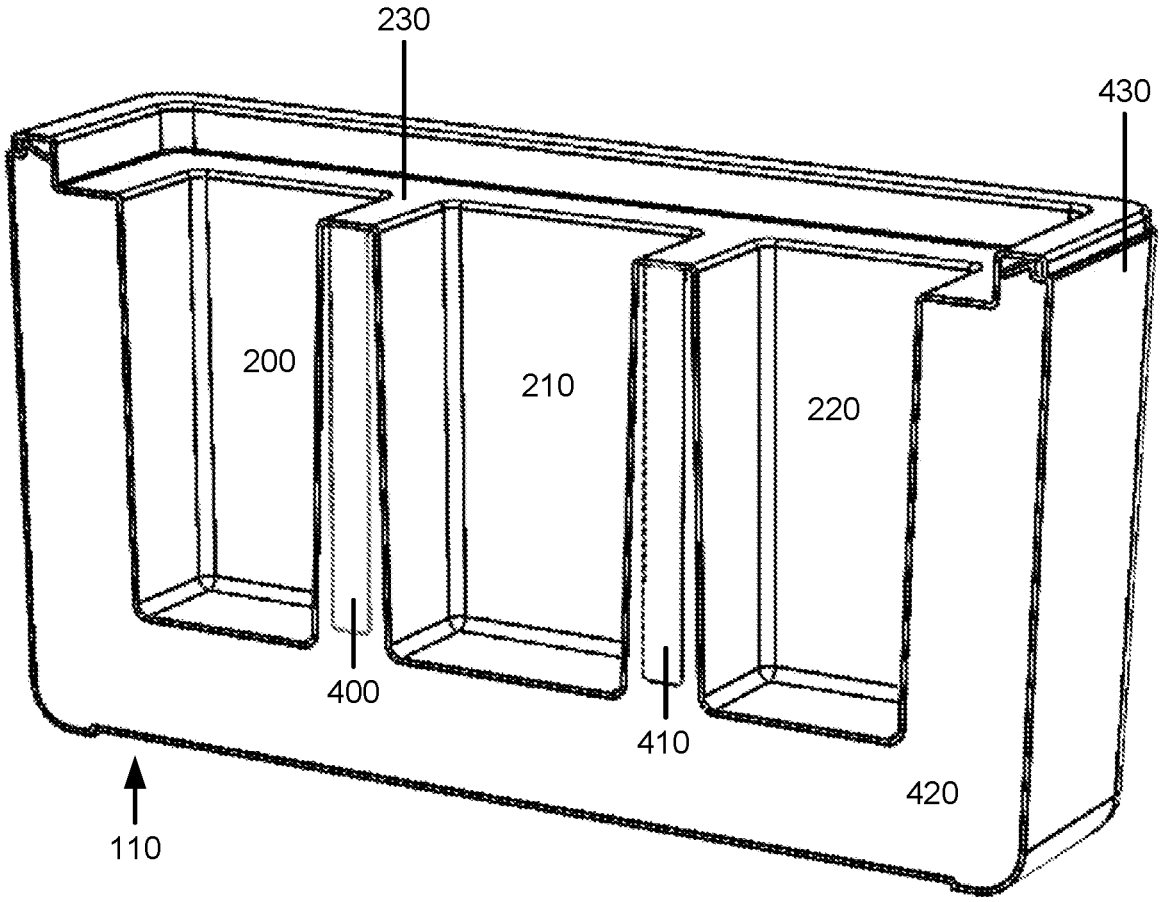
FIG. 5 is a schematic of a medicinal carrier device.

FIG. 5 depicts a cross-section vertical view through the center of a storage portion 110 of a medicinal carrier device. The storage portion 110 is surrounded by an outer covering 430. An internal section of insulation 420 is positioned within the outer covering 430 and affixed to the outer covering 430. A liner 230 is positioned to form a first side region 200 and a second side region 220 with a central storage region 210. The first panel of phase change material 400 is positioned between the first side region 200 and the central storage region 210. The first side region 200 is of a size, shape and position so that one or more portable cold packs positioned within the first side region 200 have solid thermal contact with the first panel of phase change material 400 through the thermally-conductive liner material. Similarly, the second side region 220 is of a size, shape and position so that one or more portable cold packs positioned within the second side region 220 have solid thermal contact with the second panel of phase change material 410 through the thermally-conductive liner material. The first and second panels of phase change material 400, 410 are sized so that the portable cold packs positioned within the first and second side regions 200, 220 are not in direct thermal contact with the storage region 210. The first and second panels of phase change material 400, 410 are sized so that the portable cold packs positioned within the first and second side regions 200, 220 are in direct thermal contact with the first and second panels of phase change material 400, 410. For example, the first and second panels of phase change material 400, 410 are of a height and width so that the adjacent portable cold packs are not directly adjacent to the internal surfaces of the liner within the central storage region 210, as the first and second panels of phase change material 400, 410 are always positioned between the portable cold packs and the internal surfaces of the liner within the central storage region 210.

Figure 6A:
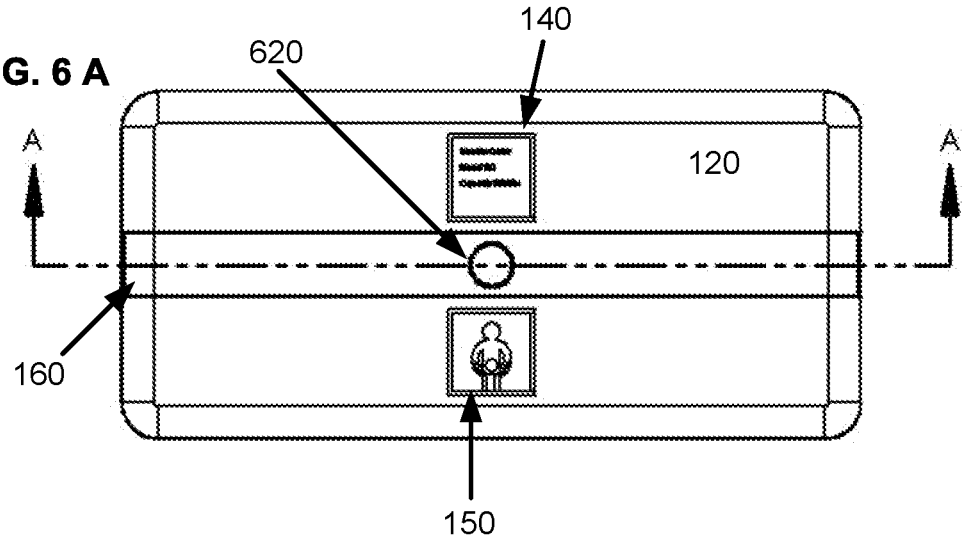
FIG. 6A is a schematic of a medicinal carrier device.

FIG. 6A depicts a top-down view of a medicinal carrier device 100. The view shows a lid 120 with a top label area 140 and a latch 150. An indentation 160 of a size and shape to mate with a strap or handle runs along the length of the rectangular lid 120. In the illustrated embodiment a cap 620 covers an aperture which is used during manufacture to fill the exterior shell of the lid 120 with a foam insulation.

Figure 6B:
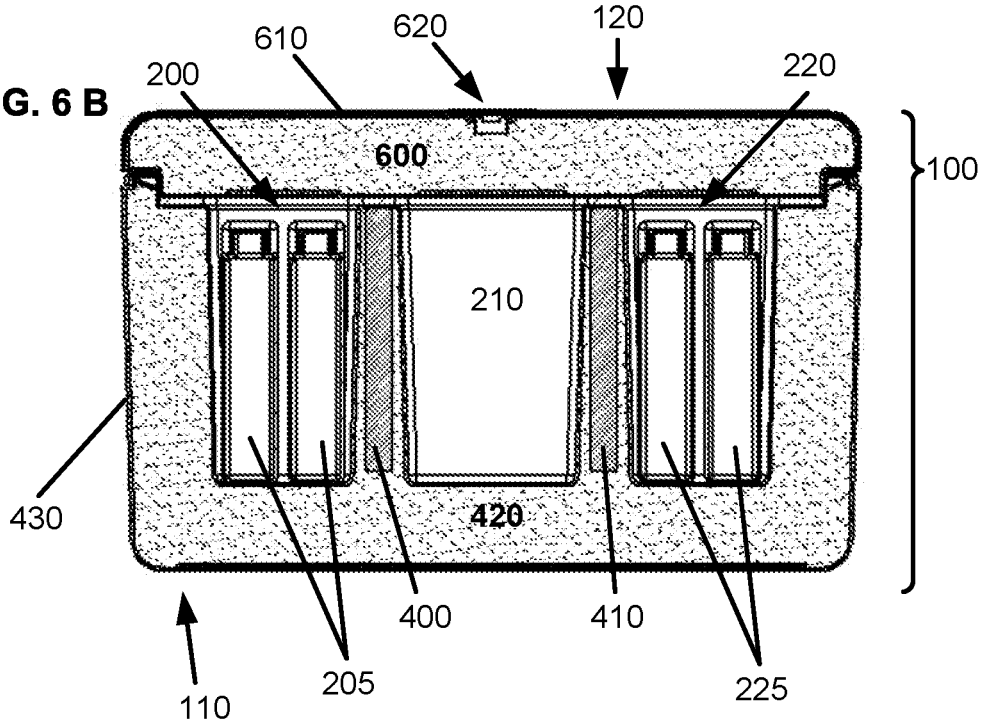
FIG. 6B is a schematic of a medicinal carrier device.

FIG. 6B shows a cross section view through a medicinal carrier device 100 such as illustrated in FIG. 6A, with a view through line A in FIG. 6A. The lid 120 includes an outer covering 610. Depending on the embodiment, an outer covering 610 can include a solid plastic or polymer material. The lid 120 interior is filled with foam insulation 600. During manufacture, the foam insulation is positioned within the outer covering 610 of the lid 120 through an aperture in the top of the lid 120, which has been closed with a cap 620.

FIG. 6B also depicts the storage portion 110 of the medicinal carrier device 100. The storage portion 110 includes an outer covering 430 surrounding a foam insulation 420 within the interior volume. A first side region 200 and a second side region 220 within the storage portion 110 each contain a pair of portable cold packs 205, 225. The side regions 200, 220 are of a size, shape and position to secure the flat side of one of the pair of portable cold packs 205, 225 against the adjacent wall with the central storage region 210. Within each wall between the side regions 200, 220 and the central storage region 210 is a panel of phase change material 400, 410. The panels of phase change material 400, 410 have top edges above the top edges of the pairs of portable cold packs 205, 225.

Figure 7A:
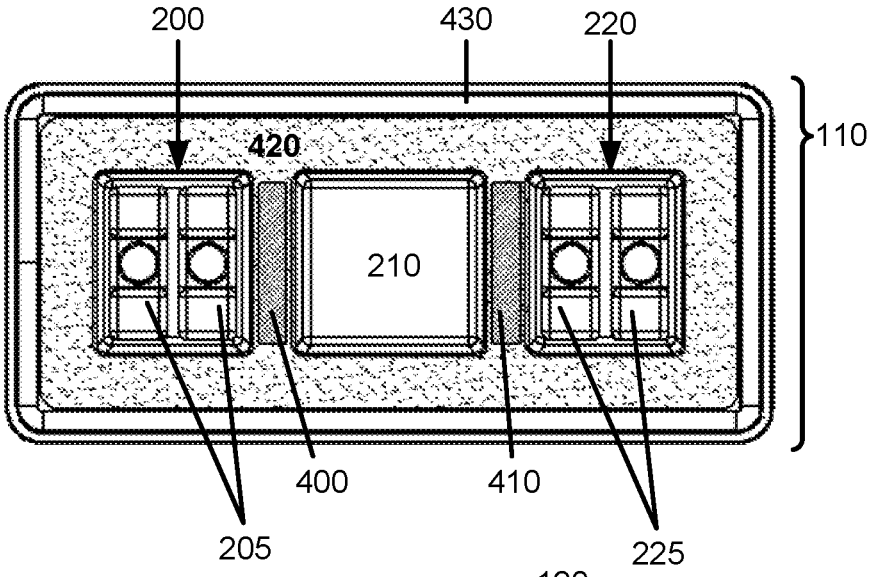
FIG. 7A is a schematic of a medicinal carrier device.
Figure 7B:
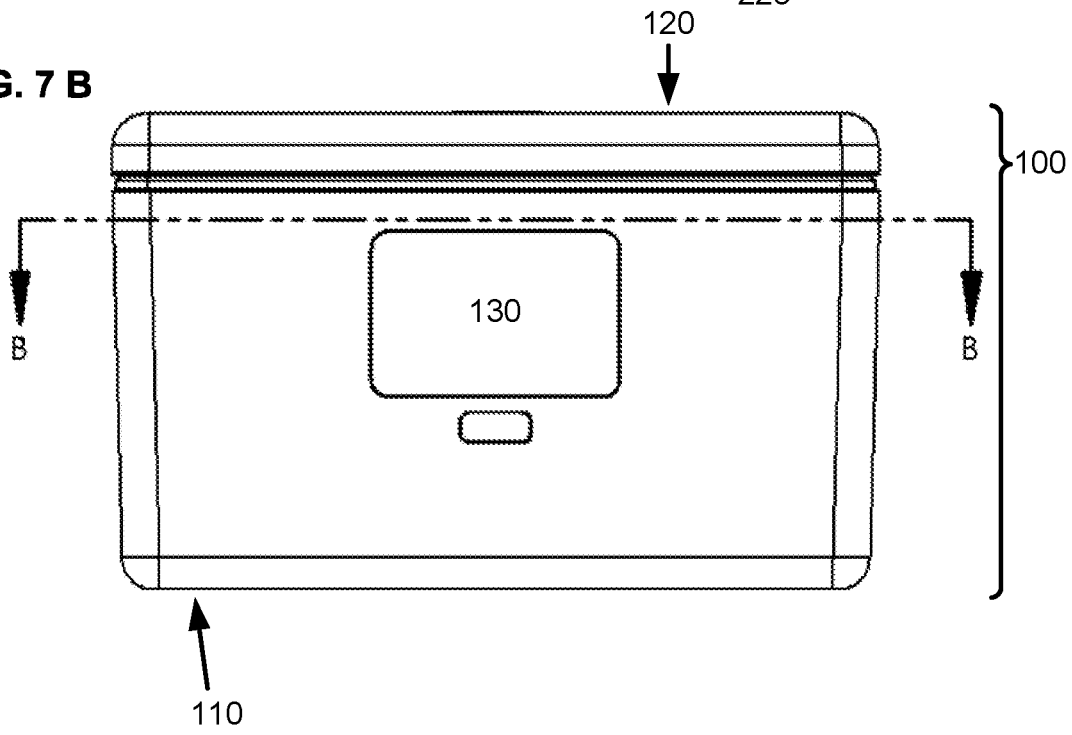
FIG. 7B is a schematic of a medicinal carrier device.

FIG. 7B illustrates a medicinal carrier device 100 in a front view. The medicinal carrier device 100 includes a storage portion 110 and a lid 120. A side labelling area 130 is included on the side of the storage portion 110.

FIG. 7A depicts a cross-section view through a storage portion 110 of a medicinal carrier device 100, such as a cut view through line B in FIG. 7B. The storage portion 110 has an outer covering 430 surrounding insulation material 420. A first side region 200 is of a size and shape to contain a first pair of portable cold packs 205. A second side region 220 is of a size and shape to contain a second pair of portable cold packs 225. Panels of phase change material 400, 410 are positioned within the walls between each of the side panels 200, 220 and the center storage region 210.

Figure 8:
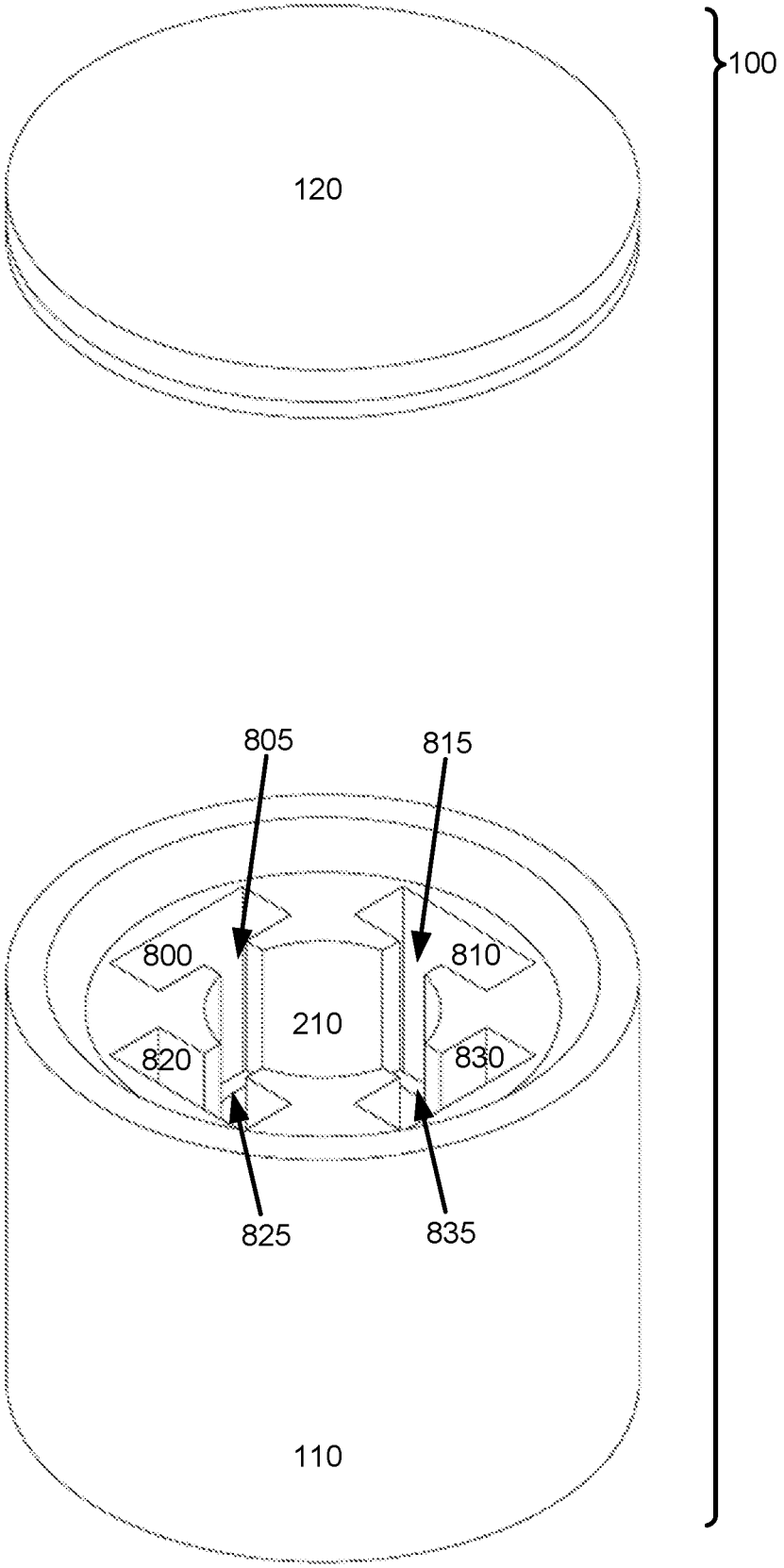
FIG. 8 is a schematic of a medicinal carrier device.

FIG. 8 depicts an embodiment of a medicinal carrier device 100. The device 100 illustrated in FIG. 8 is substantially cylindrical, which is preferred in some use situations due to packing efficiency or ease of carrying by an individual (e.g. with a shoulder strap or within a backpack). The device 100 includes a storage portion 110 and a reversibly mating lid 120. The storage portion 110 includes an outer layer and an inner mass of phase change material. In some embodiments, the inner mass of phase change material includes solid phase change material with a transition temperature in the 2-8 degree C. range. In some embodiments the inner mass of phase change material includes phase change material with a transition temperature in the 2-8 degree C. range encapsulated within an outer shell to form the structures described herein. The storage portion 110 includes a center storage region 210. The center storage region 210 is of a size and shape to hold a supply of medicinals for a use case. For example, the center storage region 210 can include a 0.5 L volume, 1 L volume, 1.5 L volume or 2 L volume depending on the embodiment. Surrounding the center storage region 210 are four equally-spaced slots 800, 810, 820, 830, each of which are of a size, shape and position to respectively secure a portable cold pack within the inner mass of phase change material adjacent to the center storage region 210.

In the embodiment illustrated, an optional opening is positioned between each of the slots and the center storage region 210, the opening of a size and shape to permit a person to reversibly slide a portable cold pack into the slot or to remove the portable cold pack from the slot. For example, slot 800 is of a size, shape and position to secure a portable cold pack within the inner mass of phase change material adjacent to the center storage region 210. Opening 805 is adjacent to the slot 800, positioned so that a person can insert and remove the portable cold pack within the slot 800. Similarly, slots 810, 820, 830 have respective adjacent openings 815, 825, 835.

Figure 9:
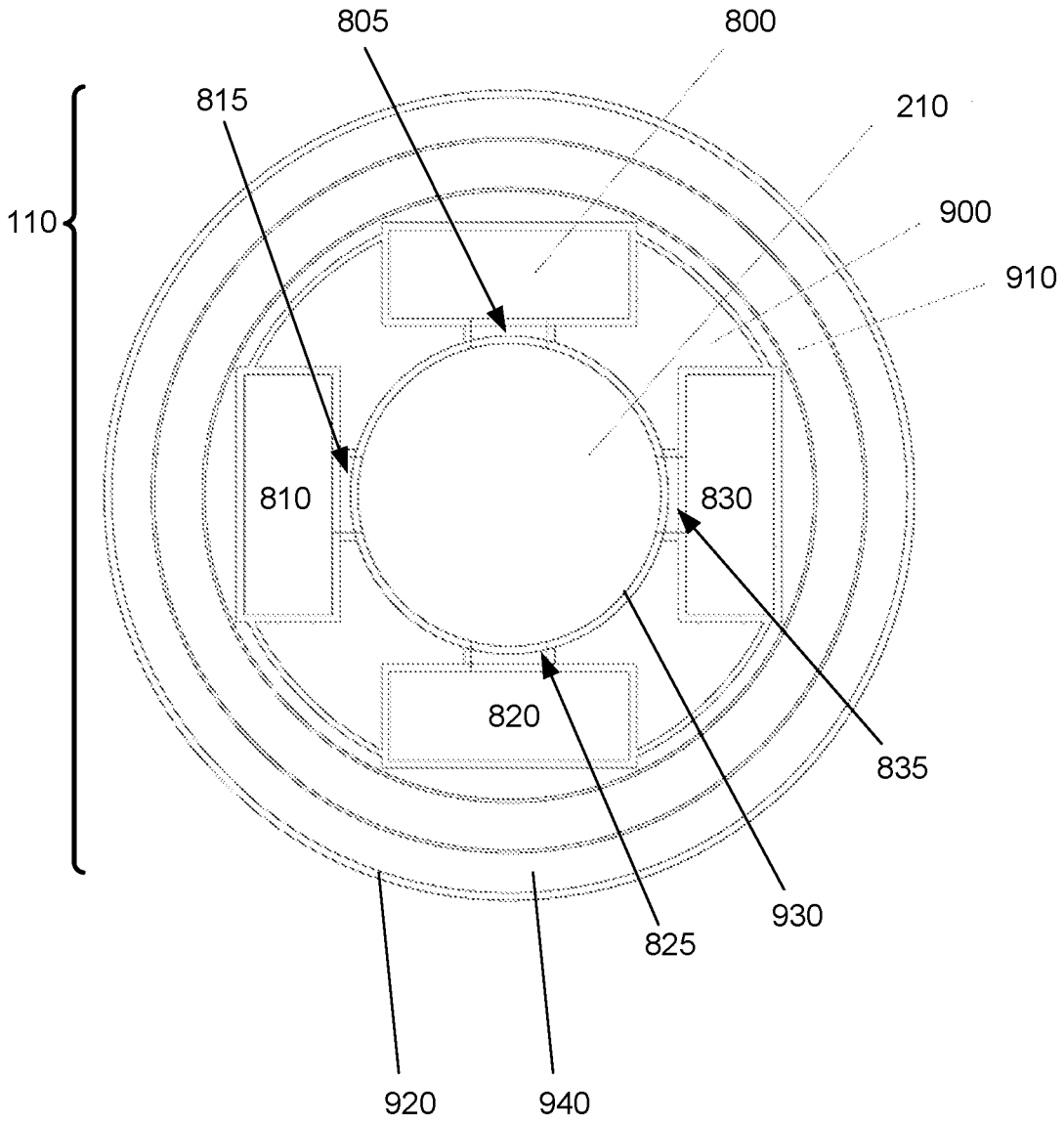
FIG. 9 is a schematic of a medicinal carrier device.

FIG. 9 illustrates an embodiment of a storage portion 110 of a medical carrier device from a top-down view. The storage portion 110 includes a center storage region 210. Surrounding the center storage region 210 is a mass of phase change material 900. Within the mass of phase change material 900 are four slots 800, 810, 820, 830, each of a size, shape and position to secure a portable cold pack within the mass of phase change material 900. Openings 805, 815, 825, 835 are positioned between each of the respective slots 800, 810, 820, 830 and the center storage region 210. The openings 805, 815, 825, 835 are wide enough to permit a user of the medical carrier device to touch the side of a portable cold pack within each of the respective slots 800, 810, 820, 830. The openings 805, 815, 825, 835 are narrow enough to not permit each of the respective portable cold packs within each of the respective slots 800, 810, 820, 830 to come in contact with material stored within the center storage region 210. This positioning protects any cold-sensitive medicinal material stored within the center storage region 210 from contact with portable cold packs that may be frozen to a temperature that could damage stored medicinal material. Optionally a liner 930 can be included adjacent to the interior surface within the center storage region 210.

Surrounding the mass of phase change material 900 in the illustrated embodiment is an inner ring 910. In some embodiments, the inner ring includes additional phase change material. The additional phase change material can, for example, have a transition temperature similar to the one used in the central mass (e.g. phase change material with a transition temperature in the 2-8 degree C. range). The additional phase change material can, for example, have a transition temperature lower than the one used in the central mass (e.g. phase change material with a transition temperature in the 2-8 degree C. range but lower than the first phase change material). The additional phase change material can, for example, have a transition temperature higher than the one used in the central mass (e.g. phase change material with a transition temperature in the 2-8 degree C. range but higher than the first phase change material). In some embodiments the inner ring includes an insulation material, such as a hollow evacuated space, foam insulation, or other insulation materials as suitable for an embodiment. The inner ring 910 is surrounded by an outer ring 940, which includes insulation material, such as a hollow evacuated space, foam insulation, or other insulation materials as suitable for an embodiment. Factors considered in the selection of insulation materials for an embodiment include cost, mass, thermal insulation efficiency, and durability in an intended use case. The illustrated embodiment also includes an optional external covering 920, for example a plastic or polymer shell of a composition selected to provide a desired durability, appearance and protection to the storage portion 110 of the medical carrier device.

Figure 10A:
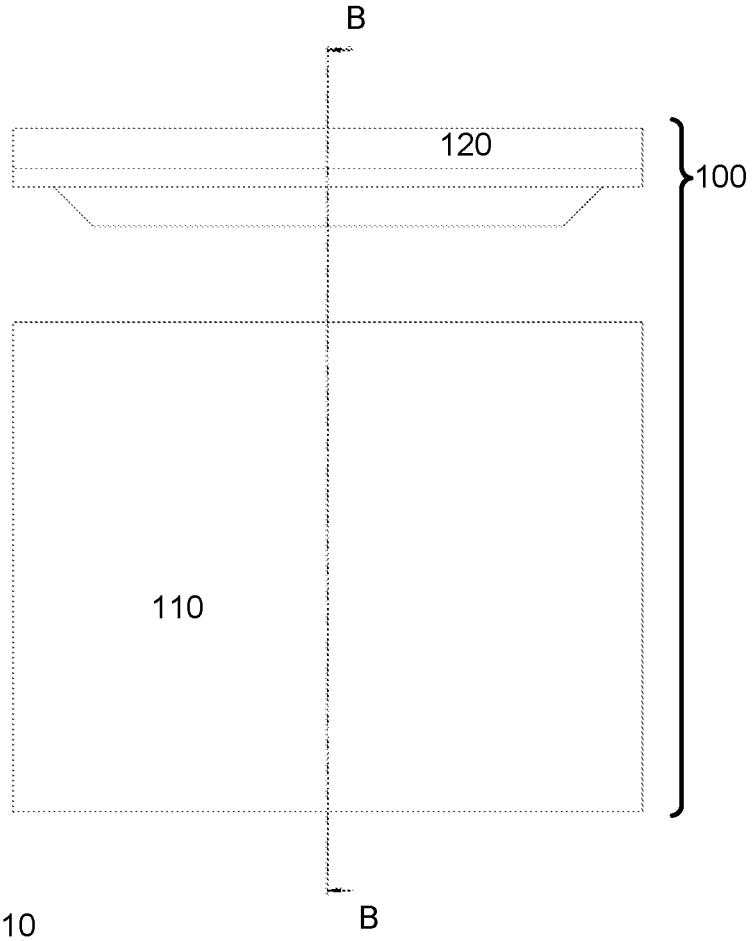
FIG. 10A is a schematic of a medicinal carrier device.

FIG. 10A illustrates an external view of a medical carrier device 100. The medical carrier device 100 includes a lid 120 and a storage portion 110. The medical carrier device 100 is substantially cylindrical. The lid 120 includes a lower face that extends downward to reversibly mate with an edge surface within the storage portion 110.

Figure 10B:
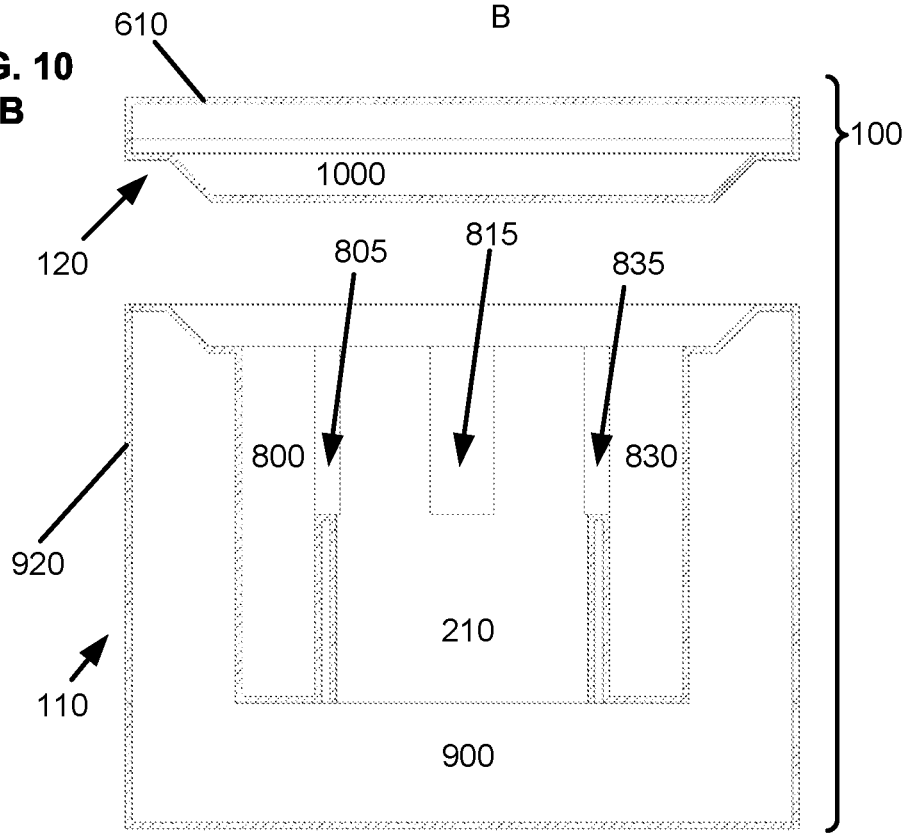
FIG. 10B is a schematic of a medicinal carrier device.

FIG. 10B illustrates a cross-section view of the medical carrier device 100, with the view taken from a cut along line B from FIG. 10A. The medical carrier device 100 includes a lid 120 and a storage portion 110. The lid 120 includes an outer covering 610. For example, an outer covering can include a plastic or polymer material. The selection of material to fabricate an outer covering can be selected depending on the embodiment based on factors such as cost, mass, durability and appearance. The lid 120 includes a lower portion of a size and shape to reversibly mate with the lower edge of the storage portion 110.

The storage portion 110 of the medical carrier device 100 illustrated in FIG. 10B includes an outer covering 920 surrounding a mass of phase change material 900. The mass of phase change material 900 is shaped to form a center storage region 210. In the illustrated embodiment, the center storage region 210 is substantially cylindrical, corresponding to the shape of the storage portion 110 of the medical carrier device 100 overall. A slot 800 of a size and shape to secure a portable cold pack is adjacent to the center storage region 210. There is an opening 805 adjacent to the slot 800, wherein the opening 805 does not extend to the bottom of the slot 800. Phase change material is present within the portion of the inner mass 900 between the opening 805 and the center storage region 210. A portable cold pack positioned within the slot 800 will, therefore, not contact the interior of the storage region 210. In some embodiments an inner liner or additional medicinal packaging is present within interior of the storage region. A second slot 830 is present at a side of the storage region 210 distal to the first slot 800. A second opening 835 is present between the second slot 830 and the storage region 210. A third opening 815 is present at the back wall of the storage region 210, which connects to a third slot (not visible in the view of the figure).

In some embodiments, a medicinal carrier device includes: one or more sections of thermal insulation positioned to form an internal space of a size and shape to hold medicinals; and one or more thermally conductive barriers positioned within the internal space between an interior medicinal storage region and one or more external portable cold pack storage regions, the one or more thermally conductive barriers formed from phase change material encapsulated within a thermally-conductive material, wherein the phase change material encapsulated within the one or more thermally conductive barriers has a latent heat of fusion greater than the specific heat capacity of portable cold packs equivalent to the volume of the external portable cold pack storage regions.

Figure 11:
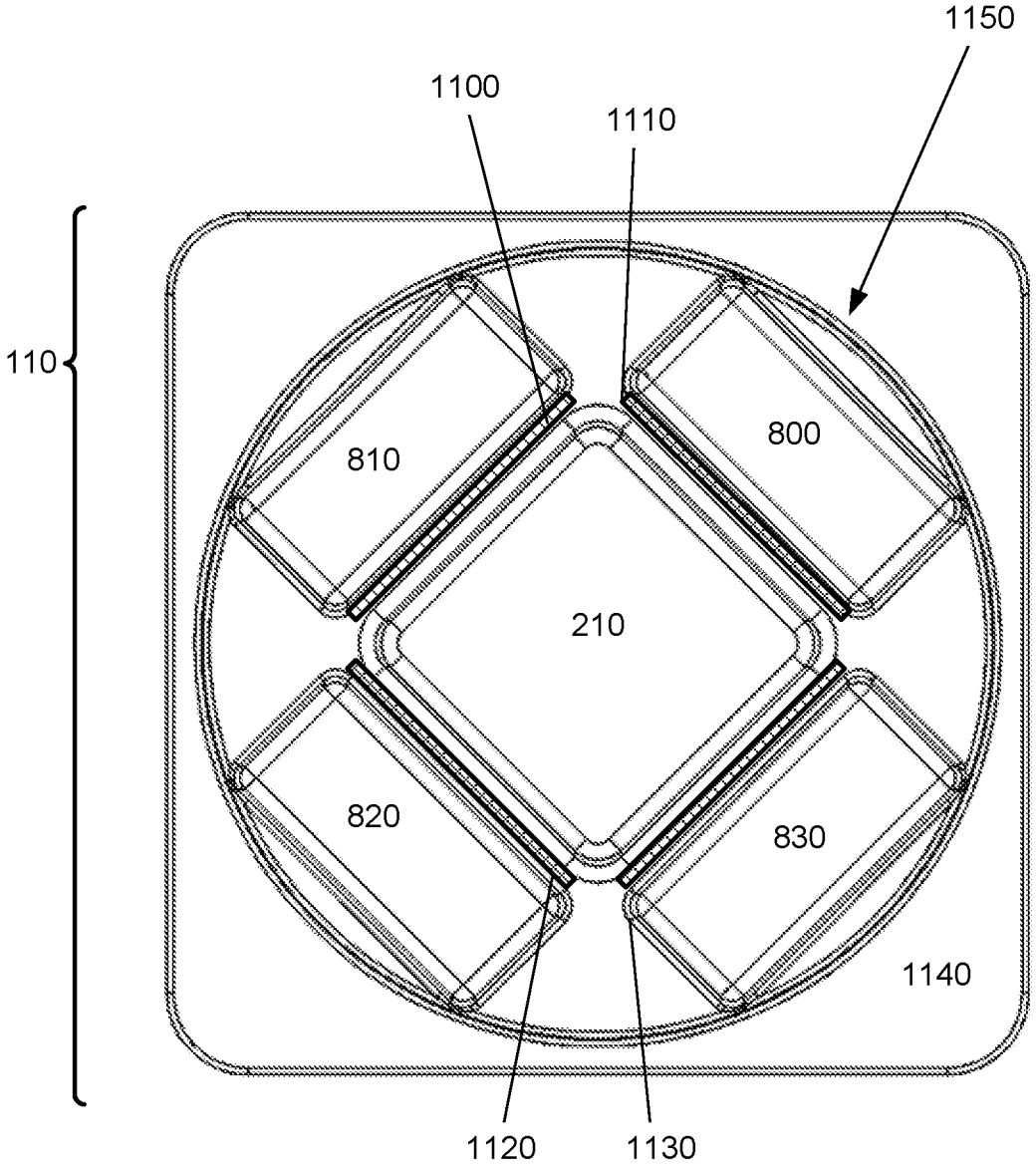
FIG. 11 is a schematic of a medicinal carrier device.

FIG. 11 depicts aspects of a medicinal carrier device. The storage portion 110 of the medicinal carrier device is depicted in a top-down view, to depict portions of the interior space. The storage portion 110 has thermal insulation 1140 shaped in a roughly rectangular shape, with a cylindrical internal space 1150 positioned in the center of the thermal insulation 1140. Depending on the embodiment, the thermal insulation can include hollow evacuated space, foam insulation, or other insulation materials. Ideally the thermal insulation materials are lightweight and durable for inclusion in the portable medicinal carrier device, which is designed for a single person to carry by hand. In the interior of the storage portion 110 is a center storage region 210. In the illustrated embodiment, the center storage region 210 is a substantially rectangular space positioned in the center of the storage portion 110. The center storage region 210 is of a size and shape to store medicinals for transport, for example packages of vaccines, anti-malarial drugs, antibiotics and similar medicinals.

Surrounding the center storage region 210 are four slots 800, 810, 820, 830, each slot of a size and shape to secure a portable cold pack. In some embodiments, a portable cold pack is an ice pack, for example a WHO-approved ice pack for medical outreach. For example, in some embodiments each slot is of a size and shape to contain a 0.6 L WHO-approved standard size ice pack. For example, in some embodiments each slot is of a size and shape to contain a 0.4 L WHO-approved standard size ice pack. Each of the slots 800, 810, 820, 830 are of a size and shape to hold the cold pack securely, including space for expansion of some materials (e.g. ice expansion relative to water).

Positioned in a gap between the center storage region 210 and each of the four slots 800, 810, 820, 830 are thermally conductive barriers 1100, 1110, 1120, 1130. Each of the thermally conductive barriers is fabricated from phase change material encapsulated within a thermally-conductive material. In some embodiments, the thermally-conductive barriers can be fabricated from microencapsulated phase change materials (for example, available from Microtek Laboratories, Ohio USA) mixed with a resin and allowed to solidify into a rectangular, board-like structure. Each of the thermally conductive barriers 1100, 1110, 1120, 1130 illustrated in FIG. 11 is a rectangular, board-like structure that substantially fills the gap between the center storage region 210 and each of the respective four adjacent slots 800, 810, 820, 830.

Operation of a medicinal carrier device including thermally conductive barriers such as those described herein relies on the relatively rapid conduction of heat from the center storage region through the thermally conductive barriers to the portable cold pack. The phase change material encapsulated within each of the thermally conductive barriers has a latent heat of fusion greater than the specific heat capacity of a portable cold pack equivalent to the volume of the adjacent portable cold pack storage region. For example, relative to FIG. 11, slot 800 is of a size, shape and volume to hold a cold pack with a known volume and composition, and therefore a known heat capacity. The adjacent thermally conductive barrier 1110 will have a latent heat of fusion greater than that known heat capacity of the adjacent portable cold pack storage region. In many embodiments, the initial temperature of the portable cold packs prior to use can be estimated (e.g. −25° C., a standard freezer temperature) so the expected heat capacity of the portable cold pack can be estimated.

In some embodiments, the phase change material encapsulated within the thermally-conductive material fabricating a thermally conductive barrier includes encapsulated phase change material having a melting temperature of 6° C. In embodiments intended for use with cold packs containing water and ice, the center storage region can be rapidly equilibrated to a temperature range between 2° C. and 8° C. using the materials and devices described herein, for example within 2 hours of placement of the portable cold packs within the device.

Figure 12:
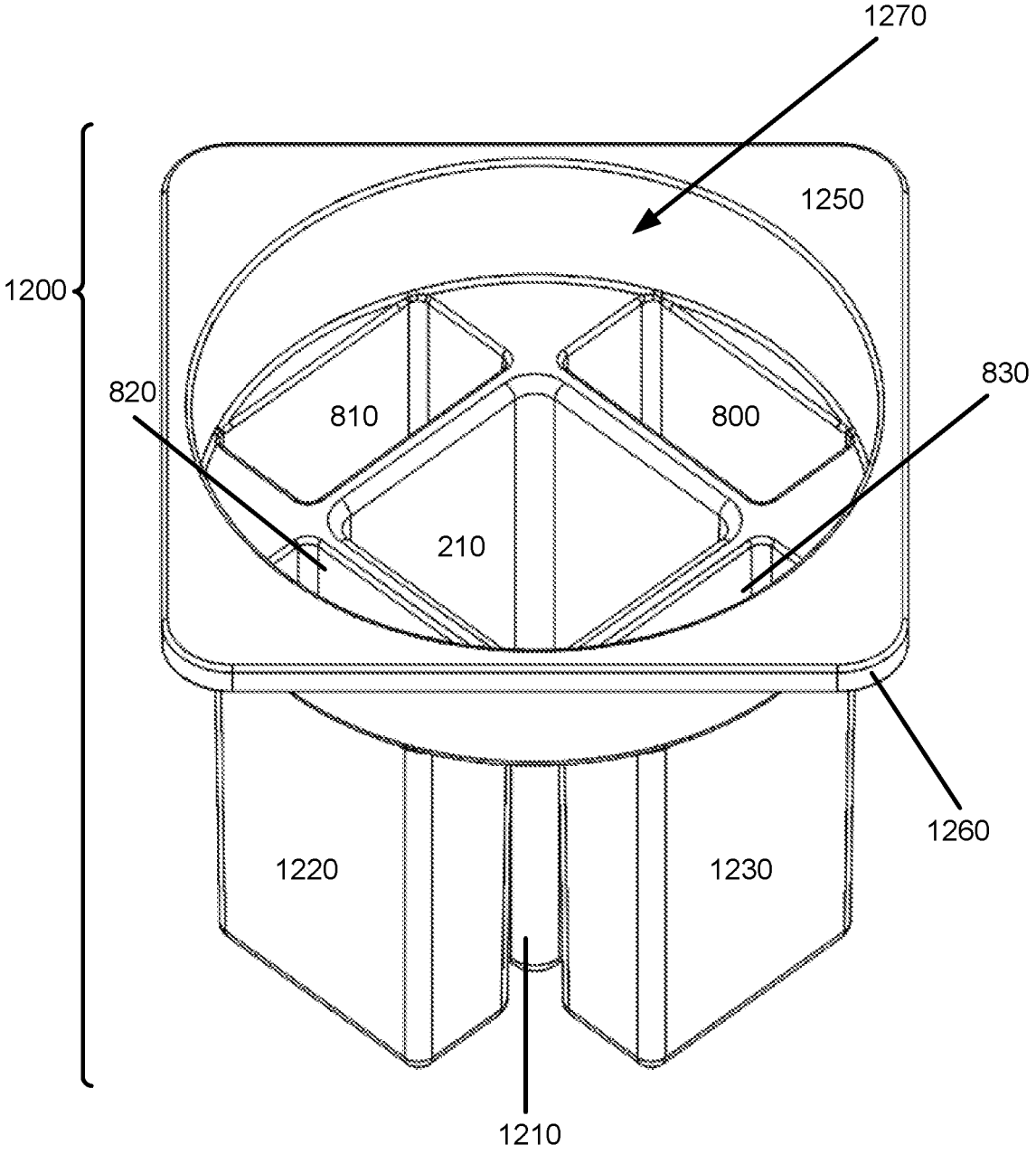
FIG. 12 is a schematic of a liner for a medicinal carrier device.

Some embodiments include fabrication of a portable medicinal carrier device with a liner. Wherein a liner is positioned adjacent to a thermally conductive barrier, such as between a thermally conductive barrier and a portable cold pack, it can be fabricated from a thermally-conductive material. FIG. 12 depicts a liner for use as a component of a medicinal carrier device. The liner 1200 fits within an outer shell (not illustrated) to form compartments and regions within the carrier. The liner 1200 includes a top edge 1250 affixed to a side edge 1260. When in position for use with an outer shell, the side edge 1260 fits against the inner wall of the outer shell and can be bonded to the outer shell wall. The size and shape of the top edge 1250 can position the interior region 1270 of the carrier relative to insulation material positioned around the exterior of the interior region 1270 within the outer shell wall of a complete carrier device.

The liner includes an interior region that includes a plurality of slots of a size, shape and position to hold portable cold packs around a central storage region. In the embodiment illustrated in FIG. 12, the interior region 1270 includes four slots 800, 810, 820, 830 surrounding a center storage region 210. Each of the slots 800, 810, 820, 830 is formed by a rectangular portion of the liner 1200 with a large flat side positioned adjacent to a flat side of the rectangular center storage region 210. For example, liner region 1220 is a rectangular structure forming slot 820. Similarly, liner region 1230 is a rectangular structure forming slot 830. The center storage region 210 is formed by a cuboid central region 1210 of the liner. During use, a thermally conductive barrier is positioned under the liner 1200 between each side of a slot adjacent to a side of the center storage region 210. Each thermally conductive barrier is positioned to provide heat transfer from the adjacent center storage region wall through the thermally conductive barrier into the adjacent slot and the portable cold pack within the adjacent slot. Although the embodiment shown in FIG. 12 includes rectangular and cuboid regions of the liner, in some embodiments the regions forming the slots and central storage region are other mating shapes, for example curved or arc-shaped slots surrounding a cylindrical center region.

Figure 13:
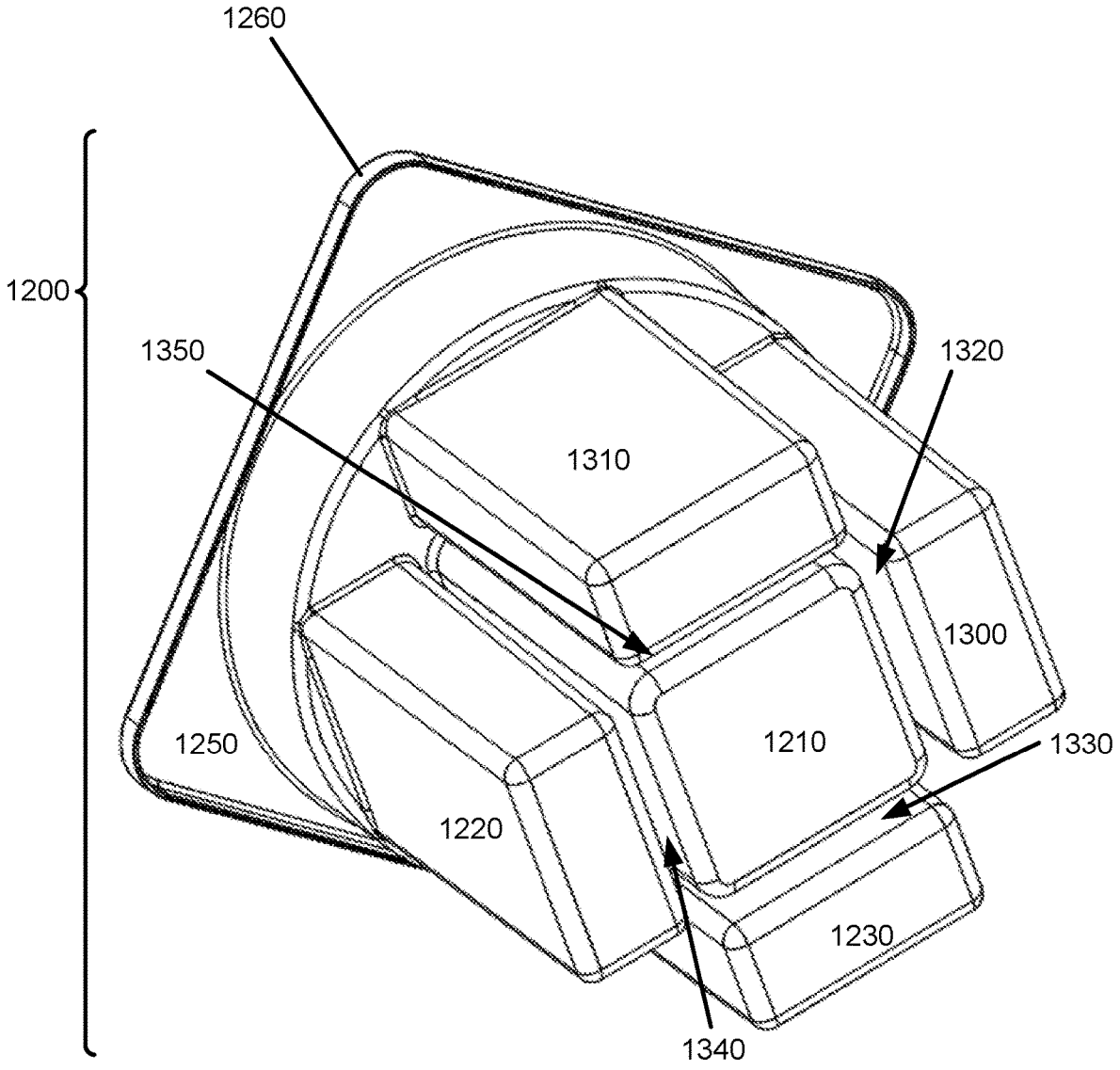
FIG. 13 is a schematic of a liner for a medicinal carrier device.

FIG. 13 illustrates aspects of a liner 1200 from a lower perspective than that of FIG. 12. The liner 1200 includes a top edge 1250 affixed to a side edge 1260. When the liner 1200 is positioned within an outer shell, the gap between the side edge 1260 and the wall of the outer shell forms space for inclusion of insulation material. For example, during manufacture, plastic foam can be added around the regions 1220, 1230, 1300, 1310 forming the slots of the carrier and enclosed within the outer wall of the carrier. The liner 1200 includes four rectangular regions 1220, 1230, 1300, 1310 forming the slots of the carrier, the regions 1220, 1230, 1300, 1310 surrounding a central rectangular region 1210 which forms the center storage region of the carrier. Each of the regions 1220, 1230, 1300, 1310 has a large flat side adjacent to a flat side of the central rectangular region 1210, and of a similar size. A gap is positioned between the wall of each of the outer regions 1220, 1230, 1300, 1310 and the adjacent wall of the central region 1210. Gap 1350 is positioned between region 1310 and the center region 1210. Gap 1320 is positioned between region 1300 and the center region 1210. Gap 1330 is positioned between region 12300 and the center region 1210. Gap 1340 is positioned between region 1220 and the center region 1210. In some embodiments, a thermally conductive barrier material that is a solid panel (e.g. see Examples) is positioned within the gap during manufacture of a carrier. In some embodiments, a thermally conductive barrier material is applied while it is wet and then allowed to dry or cure within the gap.

For each gap, an amount of thermally conductive barrier material is positioned between the cold pack storage region and the central storage region that is calculated to be sufficient to have a latent heat of fusion greater than the specific heat capacity of portable cold packs equivalent to the volume of the external portable cold pack storage regions. The heat of fusion of the thermally conductive material can be approximated by the heat of fusion of the encapsulated phase change material (PCM) within the thermal barrier material. The minimum amount of PCM required in a particular section of thermally conductive barrier of a medicinal carrier device, such as a freeze-free vaccine carrier, is determined by calculating the minimum amount of heat required to raise the temperature of the expected portable cold pack (or packs in some embodiments) to be used in the adjacent region from its storage temperature to a use temperature. In many embodiments, a preferred PCM material has a melting point of 6° C. to equilibrate ice/water containing cold packs with a storage region to a temperature in the 0.5° C. to 8° C. range.

In some embodiments, a medicinal carrier device includes: one or more sections of thermal insulation positioned to form an internal space of a size and shape to hold medicinals; and one or more thermally conductive barriers positioned within the internal space to form an interior medicinal storage region and one or more external portable cold pack storage regions, the one or more thermally conductive barriers formed from phase change material encapsulated within a thermally-conductive material, wherein the one or more thermally conductive barriers have a heat capacity, volume and thermal conductivity sufficient to cool the internal space to between 0.5° C. and 8° C. in less than 2 hours from a time point when all of the external portable cold pack storage regions are filled with portable cold packs of a temperature less than minus 10° C., and to maintain the internal space to between 0.5° C. and 8° C. for at least 35 hours.

In some embodiments, a medicinal carrier device includes four portable cold pack storage regions, each of a size and shape to contain a WHO-standard sized 0.4 L ice pack. In some embodiments, a medicinal carrier device includes two portable cold pack storage regions, each of a size and shape to contain a WHO-standard sized 0.4 L ice pack. In some embodiments, a medicinal carrier device includes four portable cold pack storage regions, each of a size and shape to contain a WHO-standard sized 0.6 L ice pack and a hold time of at least 35 hours of the medicinal storage region in the 0.5° C. to 8° C. range. In some embodiments, a medicinal carrier device includes two portable cold pack storage regions, each of a size and shape to contain a WHO-standard sized 0.6 L ice pack and a hold time of at least 15 hours of the medicinal storage region in the 0.5° C. to 8° C. range.

Figure 14:
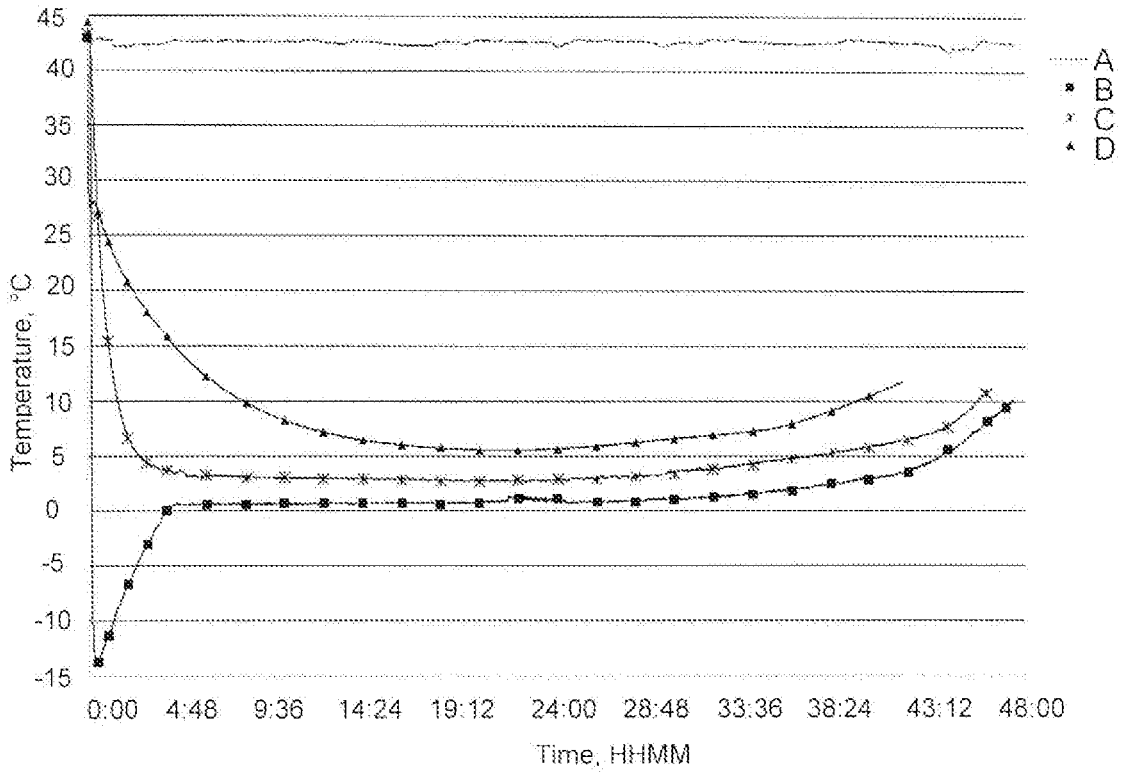
FIG. 14 is a graph of test data for medicinal carrier devices.

FIG. 14 depicts data from testing with a standard design of portable medicinal carrier device (B) and a prior design of portable "freeze-free" medicinal carrier device (D) relative to a prototype design as described herein (C). Testing was carried out using WHO-recommended parameters. The line indicated "A" shows the ambient temperature through the test, approximately 43° C. The data shows test results from the use of these carriers with portable cold packs containing ice stored at minus 25° C. prior to testing. Each of the test lines B, C, D show temperatures within the storage region of the carriers. Ideally, this type of carrier has an interior temperature 0.5° C. and 8° C. For use, it is desirable to have the interior equilibrate to this temperature quickly after addition of the cold packs, and to maintain the internal hold temperature as long as possible, or at least 35 hours.

The graph of FIG. 14 shows that the prior "freeze free" carrier design (line marked with triangles, D) requires approximately 9 hours to get to an internal storage temperature below 8° C. Once this temperature is reached, the storage region of the prior "freeze free" carrier maintains temperature between 8° C. and 5° C. for approximately 35 hours. Line B (marked with squares) indicates performance of a standard medicinal carrier (e.g. not "freeze free"). Each of these carriers includes a 1.7 L storage region interior to the carrier. The storage region of the standard medicinal carrier drops below 0° C. when the minus 25 degree cold packs are added to the carrier at time 0, then equilibrates to a temperature range above 0.5° C. at about 5 hours. Line B shows that the standard medicinal carrier maintains and internal storage region temperature in the 0.5° C. to 8° C. range until approximately 45 hours after time 0. Line C (marked with stars) depicts data from testing a medicinal carrier as described herein with 4 cold pack storage regions of 0.6 L ice packs each, in a configuration similar to those shown in FIGS. 11-13. Line C shows that the internal storage region of this carrier drops to a temperature in the 0.5° C. to 8° C. range in approximately 2 hours. The temperature of the storage region is maintained within the 0.5° C. to 8° C. range for approximately 44 hours. This data indicates that the thermally conductive barriers described with carriers herein promote equilibration of the storage region temperature quickly, without dropping below 0.5° C., and maintain temperature for more than 35 hours in the test conditions.

Figure 15:
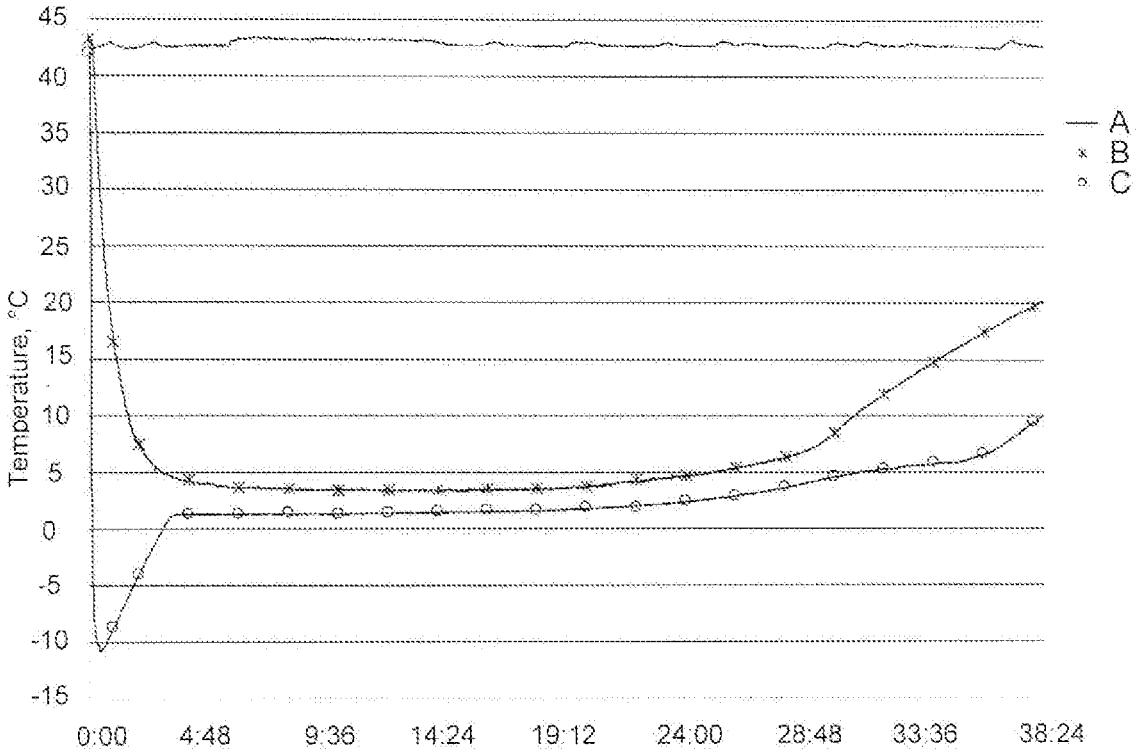
FIG. 15 is a graph of test data for medicinal carrier devices.

The graph shown in FIG. 15 illustrates the results from testing similar to that of FIG. 14. FIG. 15 shows test results of temperatures within the storage regions of carriers with a 1.7 L internal storage capacity used with four 0.4 L ice packs. Each of the ice packs was stored at minus 25° C. prior to insertion in a carrier at time 0. Line A shows the ambient temperature external to the carriers during testing, approximately 43° C. Line C (marked with circles) shows test data from a standard carrier (not freeze-free). As indicated by the graph, line C drops below 0.5° C. at time 0 and then rises to a temperature within the 0.5° C. to 8° C. range at approximately 2 hours, maintaining the storage region within this range until approximately 36 hours from time 0. The carrier including thermally conductive barriers as described herein is shown with line B (marked with stars). Line B shows that the carrier with thermally conductive barriers as described herein drops to below 8° C. range at approximately 2 hours, then maintains the storage region temperature in the 0.5° C. to 8° C. range for approximately 30 hours.

EXAMPLES

Example 1: Thermally Conductive Barriers are Fabricated from Encapsulated Phase Change Material and an Epoxy Resin In a large plastic bucket, 500 grams of TAP Plastic General Purpose Epoxy Resin—Component A and 500 grams of TAP Plastic General Purpose Epoxy Resin—Component B are mixed together using a concrete/resin mixing attachment to a power drill until thoroughly combined. In several batches, 1.3 kg of microencapsulated phase change material (MPCM6D from Microtek Laboratories in Dayton, Ohio) is immediately added to the epoxy resin mixture in the bucket and mixed until smooth. A portion of the resulting doughy mixture is compressed into an aluminum/steel mold treated with a release agent (e.g. Formula Five Mold Release Wax or PolEase 2300 Release Agent) either by hand or with a tool such as a hydraulic press to ensure that the mold is completely filled and the air bubbles and voids are minimized. The mold is closed in such a way that the excess PCM-epoxy material is expelled from the mold and removed. The PCM-epoxy mixture inside the mold is allowed to cure, typically for 15-24 hours, and then the resulting panel of hardened PCM-epoxy material is removed from the mold. The measured latent heat of fusion of the PCM-epoxy material is measured to be 100 kJ/kg.

For incorporation into vaccine carriers that use 0.4 L ice packs (see the World Health Organization's PQS Devices Catalog, section E005: Coolant Packs for Insulated Containers for many examples), a panel with dimensions 165 mm×95 mm×6 mm is produced. The dimensions may vary somewhat depending upon the exact dimensions of the type of vaccine carrier being modified to use the panel for freeze protection. For incorporation into vaccine carriers that use 0.6 L ice packs, a panel with dimensions 190 mm×120 mm×8 mm is generally produced, dimensions vary somewhat for particular carrier models. Panels of different dimensions can be made with different-sized molds. Alternatively, panels can be made different sizes by shaping (e.g. cutting, routing, sanding) other panels.

Example 2: Thermally Conductive Barriers are Fabricated from Encapsulated Phase Change Material and a Quick Curing Polyurethane Resin PCM-resin panels are made as described in Example 1 except that the epoxy components are replaced with casting polyurethane components A and B (e.g. TAP Plastic Quik-Cast Polyurethane Resin system) and the cure times are reduced to 30-60 minutes.

Example 3: Use of Thermally Conductive Barriers within a Medical Carrier Device Four 165 mm×95 mm×6 mm PCM-epoxy panels fabricated as described in Example 1 are placed inside the inner liner of a modified 1.7 L vaccine carrier (see the World Health Organization's PQS Devices Catalog, section E004: Insulated Containers for many examples) that uses four 0.4 L ice packs as portable cold packs. The liner is modified to allow space for the incorporation of the PCM-epoxy panels as barriers between the ice packs and the vaccine storage space in the center of the carrier, which increases the length of the sides of the carrier at least as much as the thickness of two PCM-epoxy panels and the thickness of any plastic coating that protects the panel. The panels are inserted into the liner and the vaccine carrier is assembled. The exterior walls of the carrier are filled with polyurethane foam using standard practices to form a freeze-free vaccine carrier.

Under ambient temperatures in the range from 10° C. to 43° C. and following standard thermal performance testing methods (e.g. those described in World Health Organization PQS Type-Testing Protocol Document WHO/PQS/E004/VC02-VP.1—Vaccine Carrier with Freeze-Prevention Technology, which is incorporated herein by reference), the temperature inside the vaccine storage space of the carrier does not drop below 0° C. when loaded and used with 0.4 L ice packs filled with water and frozen to minus 25° C. The assembled vaccine carrier cools down to 10° C. within 2 hours of adding ice packs frozen to minus 25° C. The assembled vaccine carrier maintains a temperature between 0° C. and 10° C. for at least 30 hours.

A separate freeze-carrier vaccine of the same dimensions, with similar thermal performance, is also produced using polyurethane-based PCM panels as described in Example 2.

Example 4: Use of Thermally Conductive Barriers within a Medical Carrier Device A freeze-free vaccine carrier is prepared as described in Example 3, but an additional 90 mm×90 mm×6 mm panel is placed inside the inner liner at the bottom (floor) of the vaccine storage chamber. The resulting freeze-free vaccine carrier is thermally tested and shown to cool down to 10° C. within 2 hours of adding ice packs frozen to minus 25° C. The assembled vaccine carrier maintains a temperature between 0° C. and 10° C. for at least 30 hours.

A separate freeze-carrier vaccine of the same dimensions, with similar thermal performance, is also produced using polyurethane-based PCM panels as described in Example 2.

Example 5: Use of Thermally Conductive Barriers within a Medical Carrier Device Four 190 mm×165 mm×8 mm PCM-epoxy panels fabricated as described in Example 1 are placed inside the inner liner of a modified 3.4 L vaccine carrier (see the World Health Organization's PQS Devices Catalog, section E004: Insulated Containers for many examples) that uses four 0.6 L ice packs and assembled and tested as described in Example 3. Upon loading with four water-filled ice packs at minus 25° C., the carrier cools down to 10° C. within 2 hours of adding ice packs and maintains a temperature between 0 and 10° C. for over 40 hours.

A separate freeze-carrier vaccine of the same dimensions, with similar thermal performance, is also produced using polyurethane-based PCM panels as described in Example 2.

Example 6: Use of Thermally Conductive Barriers within a Medical Carrier Device A freeze-free vaccine carrier is prepared as described in Example 4, but an additional 157 mm×157 mm×8 mm panel is placed inside the inner liner at the bottom (floor) of the vaccine storage chamber. The resulting freeze-free vaccine carrier is thermally tested and shown to shown to cool down to 10° C. within 2 hours of adding ice packs frozen to minus 25° C. The assembled vaccine carrier maintains a temperature between 0° C. and 10° C. for at least 30 hours.

A separate freeze-carrier vaccine carrier of the same dimensions, with similar thermal performance, is also produced using polyurethane-based PCM panels as described in Example 2.

Example 7: Calculating the Volume and Composition of Thermally Conductive Barrier Material for an Embodiment of a Medical Carrier Device The minimum amount of PCM required in a thermally conductive barrier of a medicinal carrier device, such as a freeze-free vaccine carrier, is determined by calculating the minimum amount of heat required to raise the temperature of the expected portable cold pack to be used from its storage temperature to a use temperature.

For example, where ice packs are used as portable cold packs, they are available in standard sizes (e.g. 0.4 L or 0.6 L) and often stored in a minus 25° C. freezer prior to use in a carrier. At the start of use, the temperature of a minus 25° C. ice pack is raised to 0° C. (this is often called "conditioning the ice") within a carrier incorporating thermally conductive barrier material to expedite the conditioning process. To calculate the amount of heat required to condition an ice pack, the weight of the ice (kg) is multiplied by the heat capacity of ice (kJ/kg/° C.) and then multiplied by 25° C. (the temperature differential from minus 25° C. to 0° C.). For example, a 0.6 L ice pack requires at least 0.6 kg×2 kJ/kg/° C.×25° C. or 30 kJ of heat to condition it. With a latent heat of fusion of PCM-resin material of 100 kJ/kg, at least 0.33 kg of PCM-resin material is needed for each ice pack used in the freeze-free vaccine carrier. More PCM-resin may be needed depending upon the efficiency of the phase change while heat is being transferred to the ice pack.

Using this calculation, PCM-resin quantities can be tuned for different sized ice packs and different starting ice temperatures as needed. The minimum volume of a thermally conductive barrier material for an embodiment can similarly be calibrated to other types of portable cold packs (e.g. PCM continuing cold packs) or ice-containing cold packs stored at other temperatures (e.g. minus 10° C. or minus 50° C. may be expected in some situations).

Example 8: Use of Thermally Conductive Barriers within a Medical Carrier Device An uncured PCM-resin mixture as described in Example 1 and Example 2 is added directly to the underside of an unassembled medicinal carrier inner liner to form a thermally conductive barrier between a portable cold pack and the inner storage space. The PCM-resin mixtures is allowed to cure and the medicinal carrier is assembled and tested. Testing shows that medicinal carriers manufactured by this method have similar thermal performance to freeze-free medicinal carriers manufactured with PCM-resin panels of similar thickness and weight.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

The invention claimed is:

1. A medicinal carrier device, comprising:

one or more sections of thermal insulation positioned to form an internal space of a volume and a size and shape to hold medicinals; and at least one thermally conductive barrier fixed within the internal space to form an interior medicinal storage region on a first side of the at least one thermally conductive barrier and one or more external portable cold pack storage regions on a second side of the thermally conductive barrier, the at least one thermally conductive barrier formed from a solid material including phase change material microencapsulated within a thermally-conductive material, wherein the at least one thermally conductive barrier has a heat capacity, volume and thermal conductivity sufficient to cool the volume of the internal space from an ambient temperature to between 2° C. and 10° C. without falling below 0.5° C. in less than 2 hours from a time point when all of the one or more external portable cold pack storage regions are filled with one or more portable cold packs of a temperature less than −10° C., and to maintain the volume of the internal space to between 0.5° C. and 10° C. for at least 30 hours from the time point; and wherein the medical carrier device includes an opening between each of the one or more external portable cold pack storage regions and the interior medicinal storage region for removal and insertion of the one or more portable cold packs during use of the device.

2. The medicinal carrier device of claim 1, wherein the phase change material microencapsulated within the thermally-conductive material comprises:

phase change material having a melting temperature of 6° C.

3. The medicinal carrier device of claim 1, wherein the one or more portable cold packs equivalent to the volume of the one or more external portable cold pack storage regions comprises:

an integral number of cold packs of a standard size and shape for medicinal transport.

4. The medicinal carrier device of claim 1, further comprising:

an insert for the medicinal carrier device, the insert of a size and shape to secure the position of the at least one thermally conductive barrier relative to the medicinal storage region.

5. The medicinal carrier device of claim 1, wherein the one or more sections of thermal insulation form a rectangular structure, and the carrier includes a removable lid.

6. The medicinal carrier device of claim 1, wherein the one or more sections of thermal insulation comprise:

insulated walls.

7. The medicinal carrier device of claim 1, wherein the one or more external portable cold pack storage regions are of a size and shape to hold 0.6 L one or more portable cold packs.

8. The medicinal carrier device of claim 1, wherein the one or more external portable cold pack storage regions are of a size and shape to hold 0.4 L one or more portable cold packs.

9. The medicinal carrier device of claim 1, further comprising:

an exterior shell surrounding the one or more sections of thermal insulation.

* * * * *